US008960837B2

(12) United States Patent
Saito et al.

(10) Patent No.: US 8,960,837 B2
(45) Date of Patent: Feb. 24, 2015

(54) RECORDING APPARATUS

(71) Applicant: Seiko Epson Corporation, Tokyo (JP)

(72) Inventors: Takehiko Saito, Matsumoto (JP); Sanshiro Takeshita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/255,485

(22) Filed: Apr. 17, 2014

(65) Prior Publication Data

US 2014/0225951 A1 Aug. 14, 2014

Related U.S. Application Data

(63) Continuation of application No. 13/419,201, filed on Mar. 13, 2012.

(30) Foreign Application Priority Data

Mar. 15, 2011 (JP) ..... 2011-056419

(51) Int. Cl.

| | |
|---|---|
| ***B41J 29/38*** | (2006.01) |
| ***B41J 29/393*** | (2006.01) |
| ***B41J 2/07*** | (2006.01) |
| ***B41J 13/00*** | (2006.01) |
| ***B41J 29/02*** | (2006.01) |

(52) U.S. Cl.

CPC ..... *B41J 2/07* (2013.01); *B41J 13/0009* (2013.01); *B41J 29/023* (2013.01); *B41J 29/026* (2013.01); *B41J 29/38* (2013.01)

USPC ..... 347/14; 347/19

(58) Field of Classification Search

CPC ..... B41J 2/07; B41J 13/0009; B41J 29/023; B41J 29/38; B41J 29/026

See application file for complete search history.

(56) References Cited

U.S. PATENT DOCUMENTS 6,398,432 B1 * 6/2002 Day et al. ..... 400/88

FOREIGN PATENT DOCUMENTS

JP 2002-019204 1/2002

OTHER PUBLICATIONS

U.S. Appl. No. 13/419,201, Feb. 14, 2014, Notice of Allowance.

* cited by examiner

*Primary Examiner* — Julian Huffman

(74) *Attorney, Agent, or Firm* — Workman Nydegger

(57) ABSTRACT

A recording apparatus includes a transport roller that transports a sheet by a predetermined transportation amount along a transportation path, a printing unit that records an image on the sheet being transported in synchronization with driving of the transport roller, a position detecting mechanism that detects whether an installation position is vertical installation or horizontal installation, and a transportation amount correcting unit that corrects a transportation amount depending on the detection result of the position detecting mechanism.

4 Claims, 5 Drawing Sheets

RECORDING APPARATUS

The present application claims priority to U.S. patent application Ser. No. 13/419,201 filed on Mar. 13, 2012, which claims priority to Japanese Patent Application No.: 2011-056419, filed Mar. 15, 2011 which applications are expressly incorporated by reference herein.

BACKGROUND

1. Technical Field

The present invention relates to a recording apparatus in which vertical installation, in which a transportation position of a recording medium is a vertically upright position when recording an image, and horizontal installation, in which the transportation position of the recording medium is changed from the upright position to a horizontally laid position, can be freely selected.

2. Related Art

Hitherto, a recording apparatus has been known which includes a printing head that is held by a carriage, a platen that faces the printing head, a sheet feeding roller that is disposed on the upstream side of the printing head and feeds a sheet (recording medium) to the platen, and a sheet discharging roller that is disposed on the downstream side of the printing head and discharges the sheet from the platen (see JP-A-2002-19204). The recording apparatus prints an image on the sheet by transporting the sheet by the sheet feeding roller and the sheet discharging roller and driving the printing head while reciprocating the recording head in a direction (a main scanning direction) perpendicular to the sheet feeding direction.

In the horizontal installation of the recording apparatus, the transportation position of transporting the sheet at the printing time is the horizontally laid position changed from the upright position. In order to make the installation area smaller, it is necessary to freely select the horizontal installation and the vertical installation which is the upright position in which a sheet transportation direction is a vertical direction.

In the recording apparatus in which the vertical installation and the horizontal installation are freely selected, a problem may arise in that a difference in a feeding amount of the roller may occur since the direction of gravitational force acting on the sheet is different depending on the position of the recording apparatus when feeding the sheet. For example, in the case of the vertical installation, when the sheet is fed upward at the upright position, a minute slip may easily occur between the sheet and the roller due to the weight of the sheet. For this reason, the feeding amount tends to decrease compared to the horizontal installation. When the difference in the feeding amount of the roller occurs, the sheet may not be accurately fed. Therefore, a problem may arise in that a printing process on the sheet may not be appropriately performed and a print result may be different depending on the position of the recording apparatus.

SUMMARY

An advantage of some aspects of the invention is that it provides a recording apparatus in which vertical installation and horizontal installation are freely selected and which is capable of accurately feeding a sheet when recording an image.

According to an aspect of the invention, there is provided a recording apparatus in which vertical installation, in which a transportation position of a recording medium when recording an image is a vertically upright position, and horizontal installation, in which the transportation position of the recording medium is changed from the upright position to a horizontally laid position, can be freely selected. The recording apparatus includes a medium transporting unit that transports the recording medium by a predetermined transportation amount along a transportation path; an image recording unit that records an image on the recording medium being transported in synchronization with driving of the medium transporting unit; an installation position detecting unit that detects whether an installation position is the vertical installation or the horizontal installation; and a transportation amount correcting unit that corrects the transportation amount depending on the detection result of the installation position detecting unit.

With such a configuration, the difference in the actual transportation amount (actually transported amount) between the installation positions can be made to be almost zero by correcting the designed target transportation amount (predetermined transportation amount) depending on the installation position. For example, in the case of the vertical installation, when the actual transportation amount deteriorates, the deterioration can be cancelled by performing the correction so that the target transportation amount increases by the amount corresponding to the deterioration in the vertical installation. Accordingly, since the sheet can be accurately transported when recording the image, it is possible to suitably perform the process of recording the image on the sheet. Further, the record result is not different depending on the position of the recording apparatus. That is, the printing quality can be satisfactorily maintained irrespective of the upright position and the horizontally laid position. Furthermore, the recording medium may be transported upward at the time of the vertical installation or the recording medium may be transported downward at the time of the vertical installation.

In the recording apparatus, the transportation amount correcting unit may correct the transportation amount based on a control table storing correction data regarding each installation position.

With such a configuration, since the transportation amount is corrected based on the correction data regarding each installation position stored in advance, a calculation process may be omitted compared to a case where the correction values is calculated at the correction time.

In this case, the correction data may include correction data of each medium regarding each kind of recording medium.

Since the weight of the recording medium is considerably changed depending on the kind of recording medium, a difference in the transportation amount also changes considerably.

Accordingly, with such a configuration, since the correction data on which the kinds of recording medium are reflected is used, the recording medium can be accurately transported even when the kind of recording medium is changed.

The recording apparatus may further include a medium position detecting unit that detects a position of a front end and/or a rear end of the recording medium along the transportation path. The correction data may include section correction data regarding each of a plurality of division sections, into which the transportation path is divided and to which the position of the front end and/or the rear end detected in accordance with the plurality of division sections by the medium position detecting unit belongs.

Since the weight (load) of the recording medium put on the medium transporting unit changes considerably depending on the position of the recording medium in the transportation path, the difference in the transportation amount also changes considerably.

Accordingly, with such a configuration, since the correction data on which the position of the front end and/or the rear end of the recording medium is reflected is used, the recording medium can be accurately transported even when the position of the recording medium is changed.

In the recording apparatus, the transportation amount correcting unit may correct the transportation amount based on a relation equation indicating a relation between an actual transportation amount per unit transportation amount in the vertical installation and an actual transportation amount per unit transportation amount in the horizontal installation.

With such a configuration, since the correction value is calculated based on the relation equation at the correction time and the transportation amount is corrected, the record capacity can be reduced compared to a case where the correction data is stored in advance.

In this case, the relation equation may include a weight of each kind of recording medium as a variable.

With such a configuration, since the relation equation on which the weight of each kind of recording medium is reflected is used, the recording medium can be accurately transported even when the kind of recording medium is changed. Further, the weight of each recording medium may be detected and the weight of each recording medium may be included as a variable in the relation equation.

On the other hand, the image recording unit may record the image in accordance with an ink jet method. The recording apparatus may further include an ejection data correcting unit that corrects ejection data based on the detection result of the installation position detecting unit.

In the recording process of the ink jet method, since the image is formed by ejecting and landing ink droplets, the influence of the direction of gravitational force is considerable. For example, at the time of the vertical installation, the ink droplets are deviated from target positions due to the influence of the direction of the gravitational force, when the ink droplets are landed (so-called landing deviation).

With such a configuration, since the ejection data is corrected depending on the installation position, the landing deviation caused due to the installation position can be cancelled. Further, the record result is not different depending on the position of the recording apparatus. Even when an image is recorded in accordance with another method, the above-described configuration is applied when the recording process is changed due to the influence of the installation position.

In this case, the correction data for correcting the ejection data may include correction data of each medium regarding each kind of recording medium.

With such a configuration, since the correction data on which the kind of recording medium is reflected is used, the suitable recording process can be performed even when the kind of recording medium is changed.

The installation position detecting unit may include a weight portion that is disposed at one position in the circumferential direction and a detection mark that is disposed at one position in the circumferential direction. The installation position detecting unit may further include a rotational member that is disposed so as to freely rotate and a vertical installation detecting sensor that is disposed to confront the detection mark of the rotational member rotating by the weight of the weight portion at the time of the vertical installation and detects whether the detection mark is present.

With such a configuration, since the detection mark confronts the vertical installation detecting sensor at the time of the vertical installation, the vertical installation is detected. On the other hand, since the detection mark does not confront the vertical installation detecting sensor at the time of the horizontal installation, the horizontal installation is detected. Accordingly, the installation position can be detected with a simple configuration, compared to a case where a general gyro (triaxial acceleration sensor) is used.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to an embodiment of the invention will be described with reference to the accompanying drawings. The recording apparatus is a recording apparatus in which vertical installation and horizontal installation are freely selected. In the case of the vertical installation, the recording apparatus takes an installation position at which the recording apparatus is long at its height (the Z axis direction) with respect to its width (the Y axis direction). In the vertical installation, the recoding apparatus performs printing while transporting a sheet (recording medium) held at the upright position, and stacks and holds the discharged sheets subjected to the printing at the upright position. On the other hand, in the case of the horizontal installation, the recording apparatus upright in the state of the vertical installation is laid horizontally on the YZ plane and takes an installation position at which the recording apparatus is long in its width (the Y axis direction) with respect to its height (the Z axis direction). In the horizontal installation, the recording apparatus performs the printing while transporting the sheet held at the horizontally laid position, and stacks and holds the discharged sheets subjected to the printing at the horizontally laid position. As shown in each drawing, the X axis (right and left) direction, the Y axis (front and rear) direction, and the Z axis (upward and downward) directions are defined and the description will be made. Hereinafter, a case where the recording apparatus is basically at the vertical installation state will be described.

Figure 1:
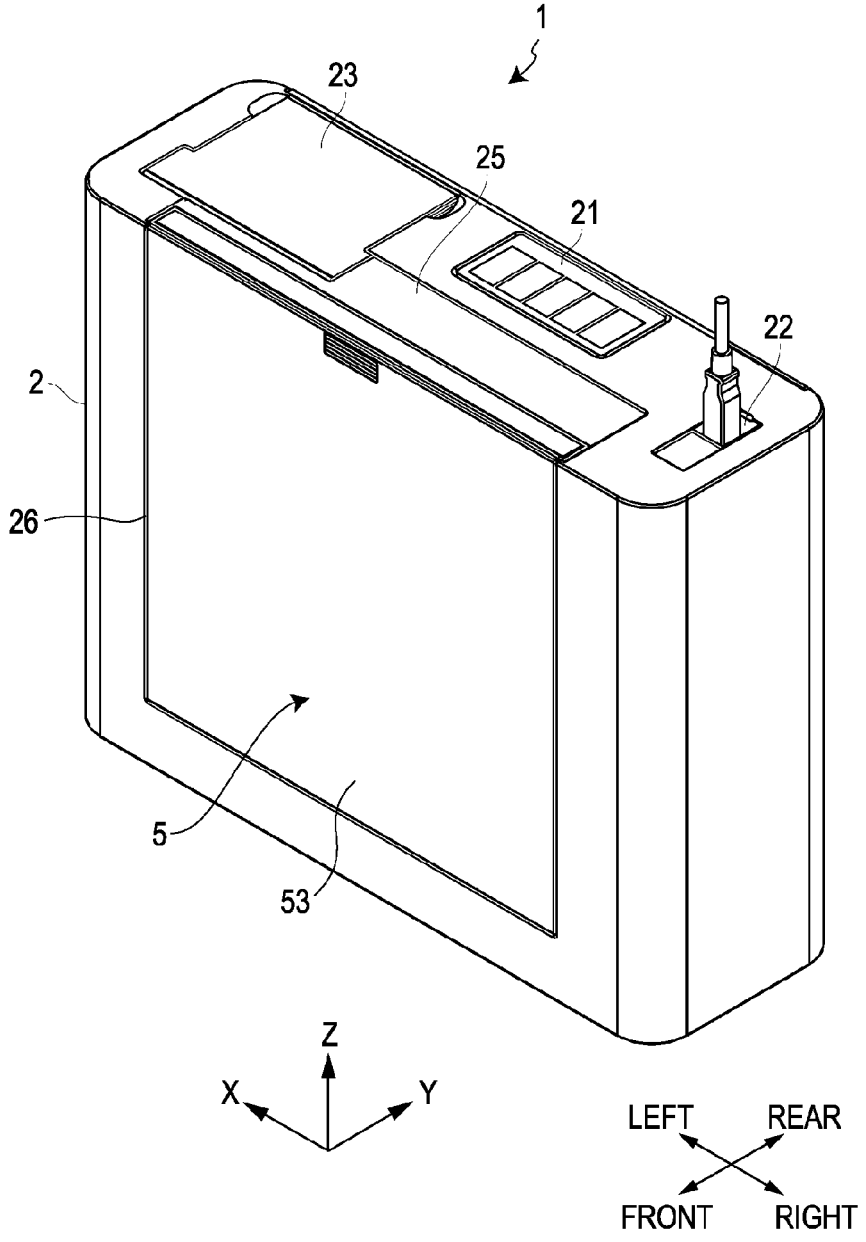
FIG. 1 is an external perspective view illustrating a recording apparatus according to an embodiment.

FIG. 1 is an external perspective view illustrating a recording apparatus 1. As shown in FIG. 1, the recording apparatus 1 includes a casing 2 that has a box-like external appearance in which a size of the Z axis direction is larger than a size of the X and Y axis directions. An operation panel 21 in which operation buttons or the like are disposed, a cable terminal 22 to which a cable connecting a PC to the recording apparatus 1 is connected, and a cartridge cover 23 which opens and closes a cartridge mounting unit (not shown) on which a plurality of ink cartridges (not shown) are detachably mounted are installed on the upper surface of the casing 2. Further, a sheet discharging port cover 25 which opens and closes a sheet discharging port 24 (see FIG. 2) discharging a sheet P subjected to printing is installed on the upper surface of the casing 2. Further, the sheet discharging port cover 25 is opened and closed by a user. However, even when printing is performed in a state where the sheet discharging port cover 25 is closed, the sheet discharging port cover 25 is configured to be automatically opened by an opening mechanism which is not illustrated in the drawing. The cassette mounting unit 26 which detachably mounts a sheet cassette 5 described below is broadly installed on the front surface of the casing 2.

Figure 2:
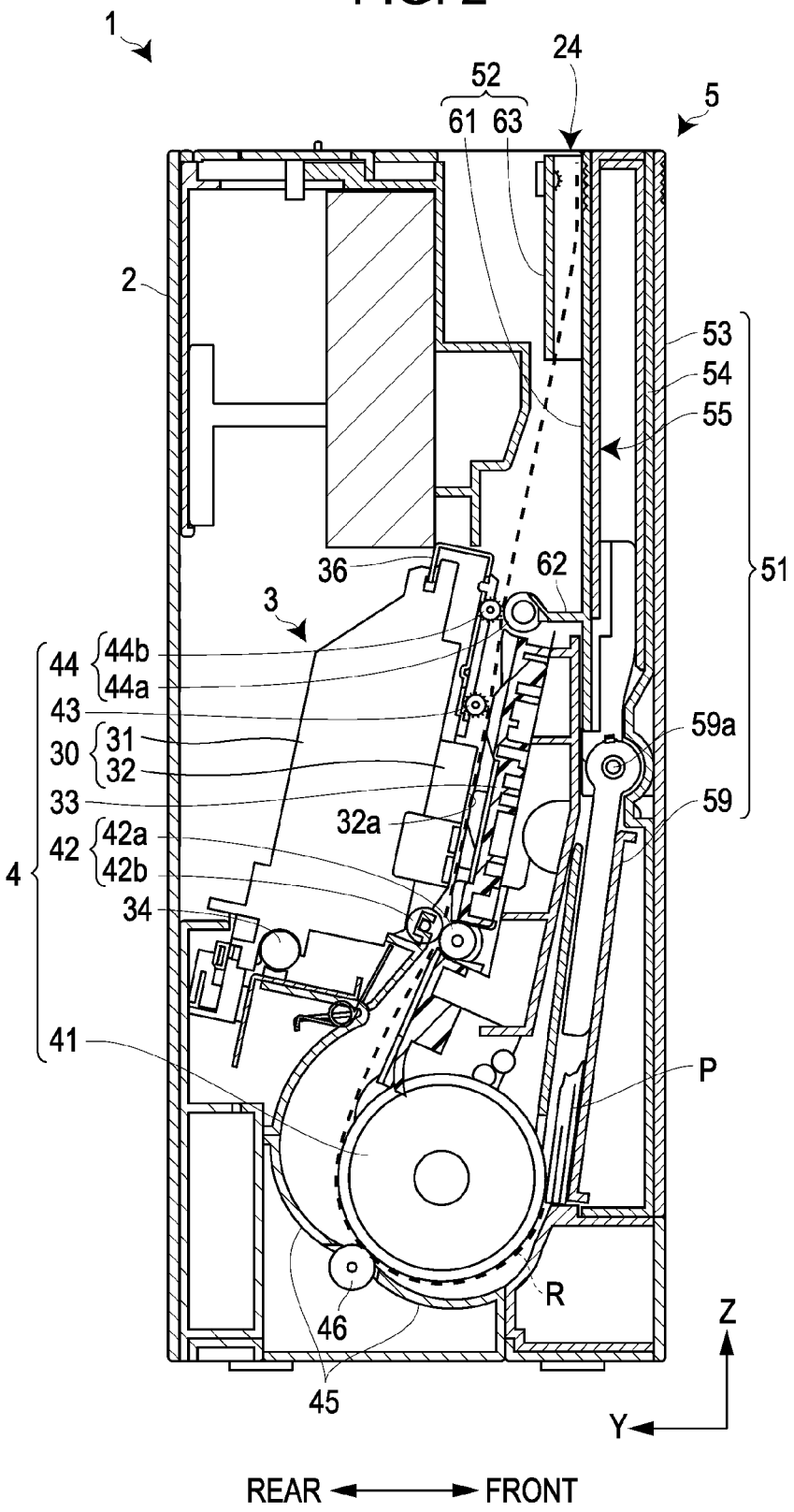
FIG. 2 is a side sectional view illustrating the internal configuration of the recording apparatus.

Hereinafter, the internal configuration of the recording apparatus 1 will be described in detail with reference to FIG. 2. FIG. 2 is a side sectional view illustrating the internal configuration of the recording apparatus 1. As shown in FIG. 2, the recording apparatus 1 includes, as internal units, a sheet cassette 5 that is detachably mounted on the cassette mounting unit 26 and accommodates each sheet P at an upright state; a transporting unit 4 that transports the accommodated sheet P along a transportation path R along which the sheet P is reversed in the lower portion of the recording apparatus 1 and is set upward; a printing unit (an image recording unit) 3 that is disposed toward the transportation path R and in the vertically middle portion of the recording apparatus 1 and prints (records) an image in accordance with an ink jet method; and an apparatus frame (not shown) that holds the transporting unit 4 and the printing unit 3. Further, the recording apparatus 1 further includes a position detecting mechanism (an installation position detecting unit) 6 (see FIGS. 3A and 3B) that detects the installation position of the recording apparatus 1 and a control unit 7 (see FIG. 4) that controls each unit. As described in detail, the control unit 7 controls driving of each unit depending on the installation position detected by the position detecting mechanism 6.

The printing unit 3 includes a carriage guide shafts 34 and 36 that are held by the apparatus frame and extend along the entire width in the X axis direction, a carriage unit 30 that is held by the carriage guide shafts 34 and 36 so as to reciprocate, and a carriage moving mechanism (not shown) that reciprocates the carriage unit 30 along the carriage guide shafts 34 and 36. The carriage guide shaft 34 holds the lower end of the carriage unit 30 and the carriage guide shaft 36 holds the upper end of the carriage unit 30 against a force enabling rotation about the carriage guide shaft 34. That is, the carriage unit 30 is held at an inclination position by the carriage guide shafts 34 and 36.

The carriage unit 30 includes a box-like carriage 31 that is held by the carriage guide shafts 34 and 36 so as to reciprocate, an ink jet head 32 that is mounted on the carriage 31, and a connection adapter (not shown) that is connected to the ink jet head 32 from the upper side and is also connected to ink cartridges via ink tubes. The ink jet head 32 includes a nozzle surface 32*a* facing the sheet P within a predetermined gap therebetween. A plurality of nozzle lines (not shown) ejecting ink droplets of a plurality of colors are formed on the nozzle surface 32*a*. The ink jet head 32 is disposed in the horizontal direction, and thus the plurality of nozzle lines extend in the height direction.

In this embodiment, the ink cartridge is installed independently from the carriage 31, and thus is an ink cartridge of a so-called off-carriage type. However, the ink cartridge may be mounted on the carriage 31, that is, may be an ink cartridge of a so-called on-carriage type. In this embodiment, the recording apparatus is a so-called serial printer which performs printing while the carriage 31 moves in the X axis direction. However, the fixed-type ink jet head 32 covering the width of the sheet P may be used. Further, the invention is not limited to the ink jet method, but other recording methods may be used.

The sheet cassette 5 includes a cassette body 51 that accommodates the sheet P not subject to printing (not subjected to recording) at the upright position and a sheet-discharge holding unit 52 that is installed on the outer surface (inner side of the apparatus) of the cassette body 51 and stacks and holds the sheets P subjected to the printing (subjected to the recording) on a holding surface 61 at the upright position. That is, the sheet P not subjected to the printing is supplied from the cassette body 51 and the sheet P subjected to the printing is discharged to the sheet-discharge holding unit 52. By detaching the sheet cassette 5 from the apparatus body, the sheet P held and subjected to the printing can be taken out together with the cassette body 51. Since the inside of the recording apparatus 1 can be exposed by detaching the sheet cassette 5, the jammed sheet P can be removed easily. Although not illustrated in the drawing, the sheet cassette 5 is configured to be slid in the Z axis direction with respect to the casing 2. Therefore, detaching and mounting operations can be performed by sliding the sheet cassette 5.

The cassette body 51 includes a cassette casing 53 that is flush with the front surface of the casing 2 at the mounting time (see FIG. 1) and forms the outer appearance of the recording apparatus 1, a body tray 54 in which a surface on the side of the cassette casing section 53 serves as an accommodation surface and is formed in a tray shape as a whole, an upper cover 55 that faces the upper portion of the body tray 54 and opens and closes a sheet accommodation space for accommodating the sheet P, and a movable tray 59 that is located in the lower portion of the body tray 54 and pivots the front end of the sheet P accommodated in the sheet accommodation space.

The movable tray 59 is installed on the downstream side of the body tray 54, which is the downstream side in a sheet transportation direction when the sheet cassette 5 is mounted, and thus serves as a so-called hopper. The movable tray 59 is configured to be rotatable about a pair of right and left pivot positions 59*a* installed substantially in the middle portion of the body tray 54 in the upward and downward directions and is also configured to be pivoted by another driving mechanism. Thus, the front end of the accommodated sheet P can be pressurized by a sheet-feeding roller 41 described below (see FIG. 2) and can be separated from the sheet-feeding roller 41 (not shown).

The sheet-discharge holding unit 52 includes a holding surface 61 that is formed by the outer surface (the inner side of the apparatus) of the upper cover 55, an accommodation section 62 that accommodates the discharged sheet P, and a holder 63 that is installed in the holding surface 61 and holds the sheet P at the upright position.

The transporting unit 4 includes the large-sized sheet-feeding roller 41 that faces the front end of the movable tray 59, comes into contact with the accommodated sheet P and takes out the sheet P, curves and reverses the sheet P, and sends the sheet P upward, a reversing guide member 45 and auxiliary driven rollers 46 that face the sheet-feeding roller 41 and guide the reverse transportation, transportation rollers (a medium transporting unit) 42 that transports the sheet P from the sheet-feeding roller 41 to the printing unit 3, a guide member 33 that is disposed on the downstream side of the transportation rollers 42 and faces the printing unit 3, a spurshaped guide roller 43 that faces the end portion of the guide member 33 on the downstream side of the guide member 33 and corrects the upward curved state of the sheet P, and sheet-discharging rollers 44 that are disposed on the downstream side of the guide roller 43 and discharge the sheet P to the sheet-discharge holding unit 52. The transporting unit 4 further includes a front-end detecting sensor that detects the front end or the rear end of the sheet P or a sheet position obtaining unit (a medium position detecting unit) 47 (see FIG. 4) that is configured by an encoder or the like of a transportation driving roller 42*a* and obtains position information regarding the position or the like of the front end of the sent sheet P.

The sheet-feeding roller 41, which is configured by a driving roller, feeds the sheet P taken out from the cassette body 51 among the outer circumferential surface in an arc shape. The reversing guide member 45, which faces the outer circumferential surface of the sheet-feeding roller 41 and is formed in a curvature shape, guides the sheet P from the outside. The auxiliary driven rollers 46, which are configured by a free rotation roller, come into contact with the sheet-feeding roller 41 with the sheet P interposed therebetween and aid the reverse transportation.

The transportation rollers 42 are configured by nip rollers that include the transportation driving roller 42*a* on the front side and a transportation driven roller 42*b* on the rear side which comes into contact with the transportation driving roller 42*a*. The transportation rollers 42 function as main rollers controlling the transportation (sub-scanning) of the sheet P. Specifically, the transportation driving roller 42*a* and the transportation driven roller 42*b* rotatably transport the sheet P onto the guide member 33 while interposing the sheet P, and further transport the sheet P by a predetermined transportation amount (target transportation amount described below) along the transportation path R. When the recording apparatus 1 is in the vertical installation state, the transportation position of the sheet P at the printing time (when recording an image) is an upward upright position. However, when the recording apparatus 1 is in the horizontal installation state, the transportation position is changed from the upright position to the horizontally laid position.

The guide member 33 forms a part of the transportation path R and regulates (guides) a gap (paper gap) between the recording surface of the sheet P and the ink jet head 32 as a predetermined gap (that is, functions as a platen). In the guide member 33, a concave portion that receives ink ejected a region deviated from the end of the sheet P at the borderless printing time is formed at a position facing the ink jet head 32. An ink absorption member (not shown) absorbing ink is installed inside the concave portion. A waste ink tank (not shown) storing the wasted ink is disposed on the lower side of the guide member 33. The guide member 33 becomes upright when the position of the recording apparatus 1 is changed to the vertical installation, whereas the upright guide member 33 is horizontally laid when the position of the recording apparatus 1 is changed to the horizontal installation.

The sheet-discharging rollers 44 are configured by nip rollers that include a sheet-discharge driving roller 44*a* on the front side and a sheet-discharge driven roller 44*b* and function as tension rollers that grant a tensile force to the sheet P on the guide member 33. The sheet-feeding roller 41, the transportation driven roller 42*b*, the guide roller 43, and the sheet-discharging rollers 44 (the sheet-discharge driving roller 44*a* and the sheet-discharge driven roller 44*b*) are each configured by a plurality of division rollers arranged at an appropriate interval in the width direction (the X axis direction) of the sheet P.

The sheet P drawn downward by the sheet-feeding roller 41 is reversed upward by the sheet-feeding roller 41, the reversing guide member 45, the auxiliary driven roller 46 and is transported to the transportation rollers 42. Further, the sheet P is pinched between the transportation rollers 42 and is transported to the printing unit 3. The sheet P subjected to the printing by the printing unit 3 is discharged to the sheet-discharge holding unit 52 of the sheet cassette 5 via the guide roller 43 and the sheet-discharging roller 44.

In the printing, the printing unit 3 records an image on the sheet P transmitted in synchronization with the driving of the transportation rollers 42. Specifically, transportation rollers 42 intermittently transmit (perform sub-scanning) the sheet P substantially in the Z axis direction, and the printing unit 3 prints an image on the sheet P by allowing the carriage moving mechanism to reciprocate the carriage unit 30 in the X axis direction (perform main scanning) while driving the ink jet head 32.

Figure 3A:
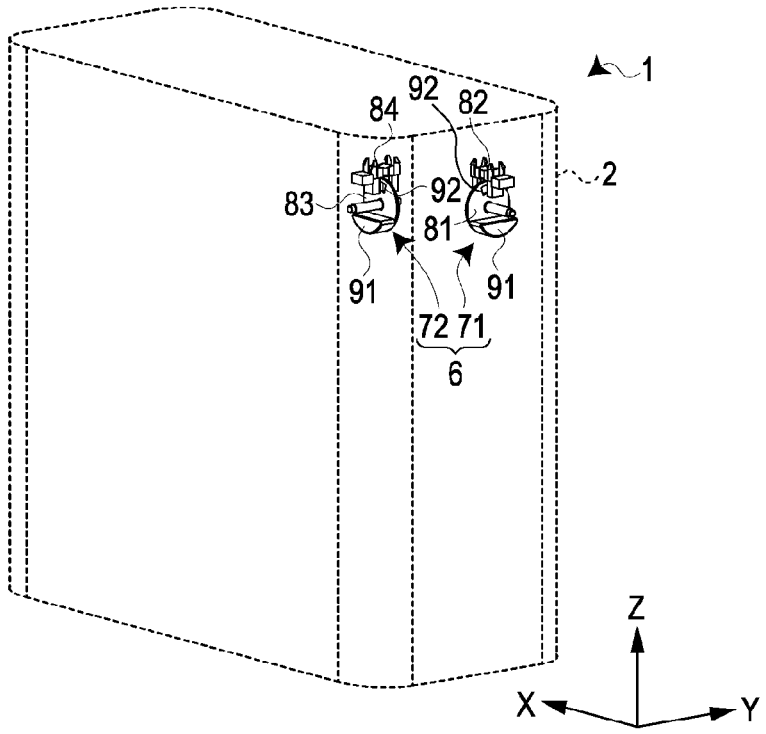
FIG. 3A is a perspective view illustrating a position detecting mechanism of the recording apparatus in a case of vertical installation and FIG. 3B is a perspective view illustrating the position detecting mechanism of the recording apparatus in a case of horizontal installation.
Figure 3B:
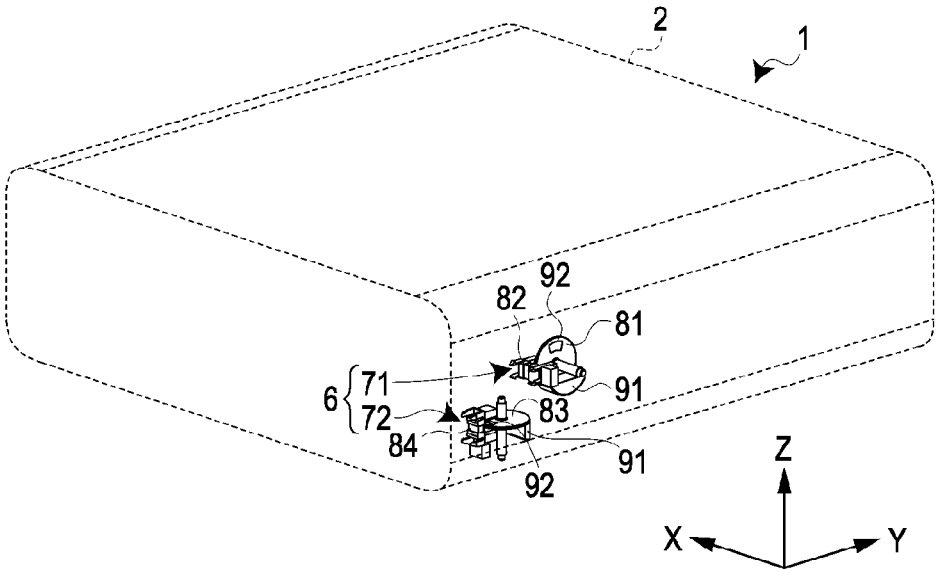

Next, the position detecting mechanism 6 will be described with reference to FIGS. 3A and 3B. FIG. 3A is a perspective view illustrating the position detecting mechanism 6 of the recording apparatus 1 in the vertical installation. FIG. 3B is a perspective view illustrating the position detecting mechanism 6 of the recording apparatus 1 in the horizontal installation. As shown in FIGS. 3A and 3B, the position detecting mechanism 6 includes a YZ position detecting unit 71 that detects the installation position in the YZ plane and an XZ position detecting unit 72 that detects the installation position in the XZ plane. Based on the detection results of both detecting units, it is detected whether the current installation position (installation position in the XYZ space) of the recording apparatus 1 is the vertical installation or the horizontal installation.

The YZ position detecting unit 71 includes a first rotational member (rotational member) 81 that is rotatably disposed in the apparatus frame and freely rotates and a first optical sensor (vertical installation detecting sensor) 82 that is disposed to face the first rotational member 81. On the other hand, the XZ position detecting unit 72 includes a second rotational member 83 that is rotatably disposed in the apparatus frame and freely rotates and a second optical sensor 84 that is disposed to face the second rotational member 83.

Each of the rotational members 81 and 83 includes a weight portion 91 that is disposed at one position (eccentric position) in the circumferential direction and a detection mark 92 that is disposed at one position symmetric to the weight portion 91 in the circumferential direction. Each detection mark 92 is formed by an opening hole. On the other hand, each of the optical sensors 82 and 84 is configured by a transmissive photosensor (photo-interrupter). Therefore, when each optical sensor confronts the detection mark 92, a light-receiving element receives light emitted from a light-emitting element so as to achieve ON detection. Each of the optical sensors 82 and 84 is disposed to confront the detection mark 92 of each of the rotational members 81 and 83 rotated by the weight of the weight portion 91 in the vertical installation and detects whether the detection mark 92 is present. Each of the rotational members 81 and 83 is held so as not to be rotated by the friction between a shaft and a bearing of each of the rotation member 81 and 83 to the extent that the rotation is caused by the weight of the weight portion 91 and the vibration is caused due to the change in the installation position.

When both optical sensors 82 and 84 detect ON, the position detecting mechanism 6 detects that the installation position is the vertical installation. On the other hand, when the first optical sensor 82 detects OFF and the second sensor 84 detects ON, the position detecting mechanism 6 detects that the position of the recording apparatus 1 is the horizontal installation due to the fact that the recording apparatus in the vertical installation state is horizontally laid on the YZ plane. The position detecting mechanism 6 transmits the detection result (information regarding whether the position of the recording apparatus is the vertical installation or the horizontal installation) to the control unit 7, as necessary. Further, when the second optical sensor 84 detects OFF, the position of the recording apparatus 1 becomes the horizontally laid position on the XZ plane. Therefore, an error signal may be configured to be transmitted to the control unit 7.

Figure 4:
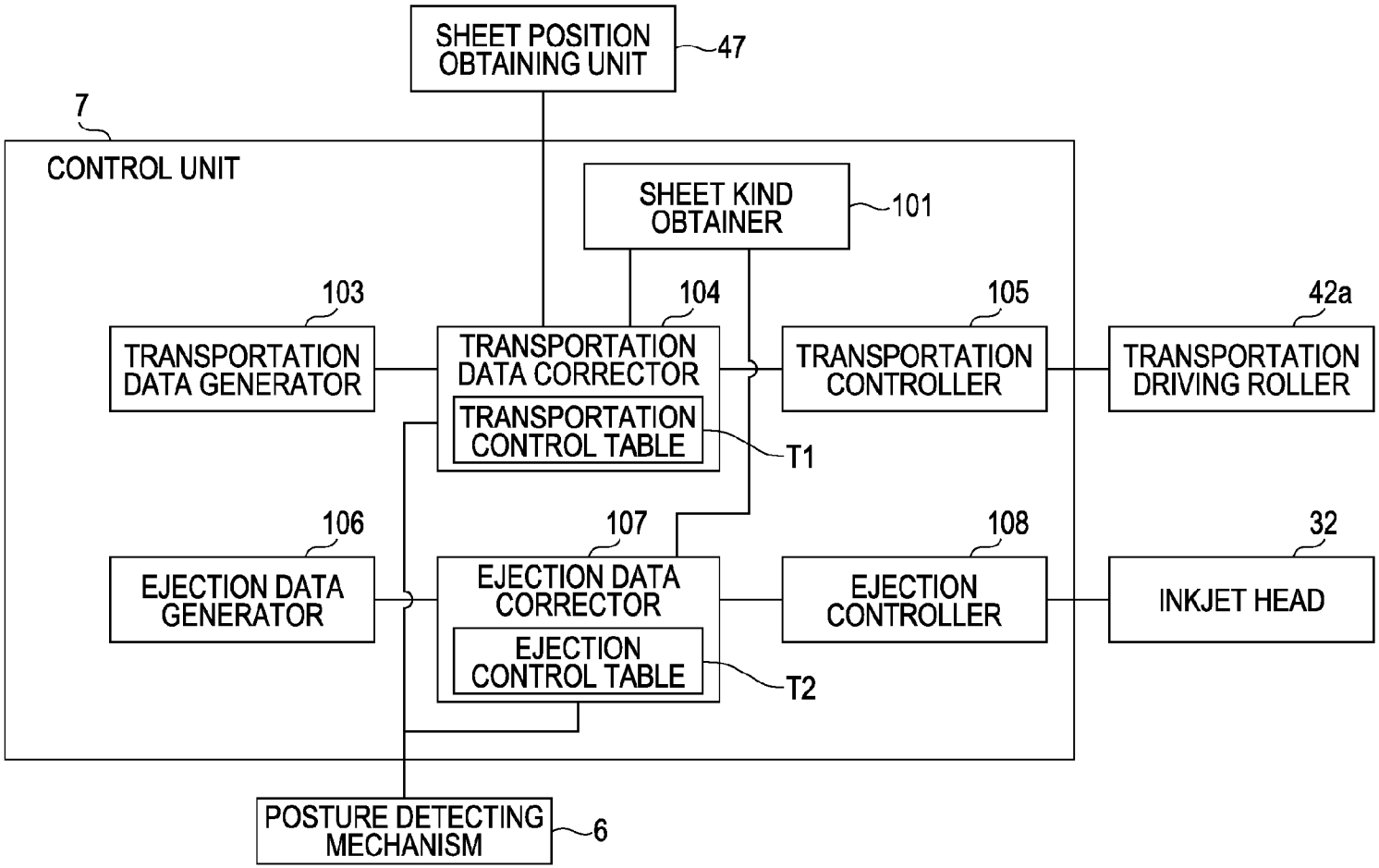
FIG. 4 is a block diagram illustrating the control configuration of the recording apparatus.

Hereinafter, the control unit 7 will be described with reference to FIG. 4. FIG. 4 is a block diagram illustrating the control configuration of the recording apparatus 1. As shown in FIG. 4, the control unit 7 includes a sheet kind obtainer 101, a transportation data generator 103, a transportation data corrector (transportation amount correcting unit) 104, a transportation controller 105, an ejection data generator 106, an ejection data corrector (an ejection data correcting unit) 107, and an ejection controller 108. The sheet kind obtainer 101 obtains a kind of sheet P from information input by a user. The transportation data generator 103 generates transportation data including a target transportation amount. The transportation data corrector 104 corrects the generated transportation data. The transportation controller 105 controls the driving of the transportation driving roller 42*a* based on the corrected transportation data. The ejection data generator 106 generates ejection data including an ejection timing of each nozzle of the ink jet head 32. The ejection data corrector 107 corrects the generated ejection data. The ejection controller 108 controls the driving of the ink jet head 32 based on the corrected ejection data. The target transportation amount is a designed target transportation amount. The transportation data corrector 104 corrects an error of the transportation amount different from the designed transportation amount.

Figure 5:
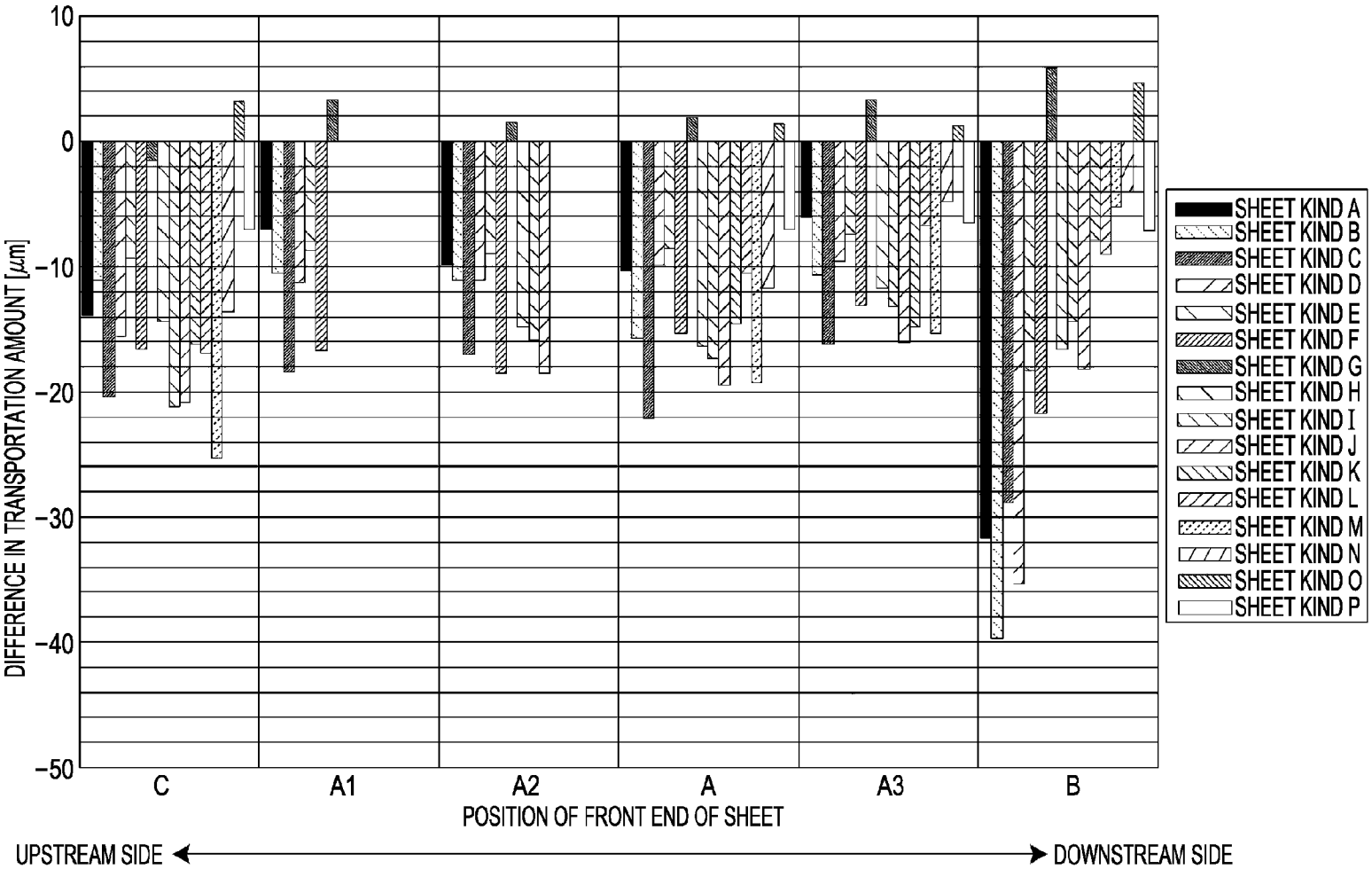
FIG. 5 is a diagram illustrating actual measurement data of a difference in an actual feeding amount per unit transportation amount between the vertical installation and the horizontal installation.

The transportation data corrector 104 performs the correction based on the installation position detected by the position detecting mechanism 6, the position of the front end of the sheet P obtained by the sheet position obtaining unit 47, the kind of sheet P obtained by the sheet kind obtainer 101, and a transportation control table (control table) T1 obtained from measured data shown in FIG. 5. An example of the measured data is shown in FIG. 5. The measured data is data that indicates a difference in the measured transportation amount of each sheet P per unit transportation amount between the vertical installation and the horizontal installation. The sheet P is divided into sections "C", "A1", "A2", "A", "A3", and "B" from the upstream side. The data indicates the difference in the transportation amount when each section passes through the transportation rollers 42. Therefore, the transportation control table T1 based on the measured data stores correction data regarding each installation position. The correction data regarding each installation position includes correction data (correction data of each medium and section correction data) regarding each kind of sheet P and each divided section of the sheet P. The transportation data corrector 104 extracts a correction value corresponding to the above-mentioned condition from the transportation control table T1, adds or subtracts the extracted correction value to or from the target transportation amount, and corrects the transportation data.

The ejection data corrector 107 corrects the ejection data based on the installation position detected by the position detecting mechanism 6, the kind of sheet P obtained by the sheet kind obtainer 101, and an ejection control table T2 obtained from measured data (not shown). Specifically, the measured data is data that indicates a landed position deviation amount (a deviation amount of the landed position of ejected ink) between the vertical installation and the horizontal installation. The ejection control table T2 stores correction data regarding each installation position based on the deviation amount of the landed position changed due to an ejection amount according to a kind of sheet P, a distance of ejection according to the thickness of the sheet P, and the like. The correction data regarding each installation position includes correction data (correction data of each medium) regarding each kind of sheet P. The ejection data corrector 107 extracts the correction value corresponding to the kind of sheet detected by the sheet kind obtainer 101 and the detected installation position from the ejection control table T2 and corrects the ejection data by the correction value. Since the ejection data is data including the ejection timing of each nozzle, the ejection data corrector 107 corrects the ejection timing with respect to the landing deviation amount in the main scanning direction and changes the ejecting nozzles with respect to the landing deviation amount in the sub-scanning direction.

In the above-described configuration, the difference in the measured transportation amount (actually transported amount) between the installation positions can be made to be almost zero by correcting the designed target transportation amount (predetermined transportation amount) depending on the installation position. Accordingly, since the sheet can be accurately transported at the printing time, the suitable printing can be performed on the sheet P. Further, the print result is not different depending on the position of the recording apparatus. That is, the printing quality can be satisfactorily maintained irrespective of the upright position and the horizontally laid position.

Since the transportation amount is corrected based on the correction data regarding each installation position stored in advance, a calculation process of calculating and comparing the correction values at the correction time may be omitted.

Since the correction data on which the kinds of sheets P are reflected is used, the sheet can be accurately transported even when the kind of sheet P is changed.

Since the correction data on which the position of the front end of the sheet P is reflected is used, the sheet can be accurately transported even when the position of the sheet P is changed.

Since the ejection data corrector 107 corrects the ejection data depending on the installation position, the landing deviation caused due to the installation position can be cancelled. Further, the record result is not different depending on the position of the recording apparatus.

Since the position detecting mechanism 6 includes the rotational members 81 and 83 and the optical sensors 82 and 84, the installation position can be detected with a simple configuration, compared to a case where a general gyro (triaxial acceleration sensor) is used.

In this embodiment, the correction value is extracted from the correction table (the transportation control table T1) stored in advance. However, the correction value may be calculated at the correction time. Specifically, the transportation data corrector 104 may correct the target transportation amount based on a relation equation that indicates a relation between the actual transportation amount per unit transportation amount in the vertical installation and the actual transportation amount per unit transportation amount in the horizontal installation. In this case, the weight of each kind of sheet P is included as a variable. For example, when a weight I of each kind of sheet P and a difference J in the actual transportation amount per unit transportation amount between the vertical installation and the horizontal installation satisfy a relation of "J=998.75×I÷1950.8", the correction value is calculated by adding the relation equation to the calculation equation. In such a configuration, since the correction value is calculated by the use of the relation equation and the transportation amount is corrected, the record capacity can be reduced compared to the case where the correction table is stored in advance. Further, since the relation equation to which the weight of each kind of sheet P is reflected is used, the sheet can be accurately transported even when the kind of sheet P is changed.

In this embodiment, the case has hitherto been described in which the position of the front end of the sheet P is obtained and the correction data regarding each division range to which the position of the front end of the sheet P belongs is used. However, correction data regarding each division range to which the position of the rear end of the sheet P belongs may be used.

Further, in this embodiment, the case has hitherto been described in which the vertical installation is set as the installation position at which the sheet P is transported upward at the printing time when the recording apparatus is upright. However, the vertical installation may be set as the installation position at which the sheet P is transported downward when the recording apparatus is upright.

What is claimed is:

1. A recording apparatus comprising:

a medium transporting unit;

an image recording unit that records an image on a recording medium being transported by the medium transporting unit; and an installation position detecting unit that detects an installation position of the recording apparatus;

wherein the image recording unit records the image in accordance with an ink jet method that ejects ink to the recording medium, and wherein the recording apparatus changes ejection data associated with the ink based on a detection result of the installation position detecting unit.

2. The recording apparatus according to claim 1, wherein the recording apparatus changes the ejection data using data that includes a kind of the recording medium.

3. The recording apparatus according to claim 1, wherein the recording apparatus changes the ejection data using data that includes a thickness of the medium.

4. The recording apparatus according to claim 1, wherein the transporting unit changes a transportation amount depending on the detection result of the installation position detecting unit.

* * * * *